United States Patent [19]

Kappen

[11] 4,414,787

[45] Nov. 15, 1983

[54] ROOF TRUSS ASSEMBLIES FOR HIPPED ROOFS, AND METHOD OF MANUFACTURING SAME

[76] Inventor: Burkhard Kappen, Skogslundsgatan 31, S-731 00 Köping, Sweden

[21] Appl. No.: 226,004

[22] Filed: Jan. 19, 1981

[30] Foreign Application Priority Data

Feb. 4, 1980 [SE] Sweden ..... 8000849

[51] Int. Cl.[3] ..... E04B 7/08; E04C 3/42

[52] U.S. Cl. ..... 52/643; 52/639; 52/693

[58] Field of Search ..... 52/90, 639, 641, 691, 52/693, 690, 643

[56] References Cited

U.S. PATENT DOCUMENTS

| | | | |
|---|---|---|---|
| 2,827,676 | 3/1958 | Sanford | 52/639 |
| 3,487,430 | 12/1969 | Schmitt | 100/913 |
| 3,599,562 | 8/1971 | Hutchens | 100/913 |

FOREIGN PATENT DOCUMENTS

| | | | |
|---|---|---|---|
| 693789 | 9/1964 | Canada | 52/639 |
| 882012 | 2/1943 | France | 52/639 |
| 1217851 | 12/1959 | France | 52/639 |
| 59922 | 1/1968 | German Democratic Rep. | 52/90 |
| 530402 | 7/1955 | Italy | 52/639 |

*Primary Examiner*—Alfred C. Perham
*Attorney, Agent, or Firm*—Amster, Rothstein & Engelberg

[57] ABSTRACT

A roof truss assembly for hipped roofs comprises a number of roof trusses of constant ceiling joist length and of a height decreasing stepwise from a maximum height. All roof trusses regardless of their height have vertical struts which are perpendicular to the ceiling joist and provided in a number at least twice as large as the number of height reduction steps. The vertical struts are provided in the same number on either side of the transverse central plane of the roof trusses, the vertical struts on one side of the plane being spaced equally far from said plane as corresponding vertical struts on the other side of said plane. This embodiment permits employing a mechanical manufacturing procedure in which the gusset plates utilized at the manufacture to fix the junctions between the rafter and the vertical struts need only be shifted in a direction at right angles to the longitudinal direction of the ceiling joist when passing from one roof truss height to another, while all other gusset plates are retained at the same places.

2 Claims, 9 Drawing Figures

ROOF TRUSS ASSEMBLIES FOR HIPPED ROOFS, AND METHOD OF MANUFACTURING SAME

Figure 1A:
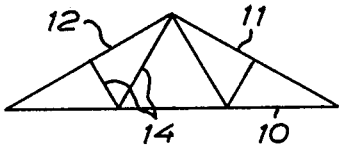
FIG. 1a PRIOR ART
Figure 1B:
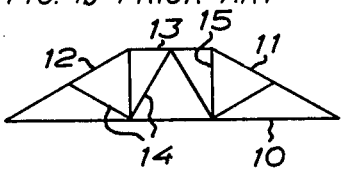
FIG. 1b PRIOR ART
Figure 1C:
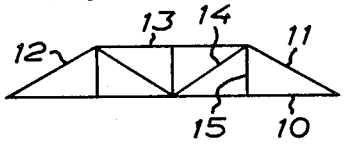
FIG. 1c PRIOR ART
Figure 1D:
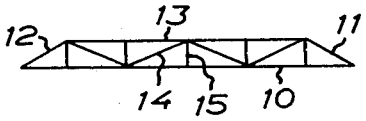
FIG. 1d PRIOR ART
Figure 2A:
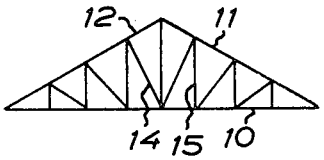
Figure 2B:
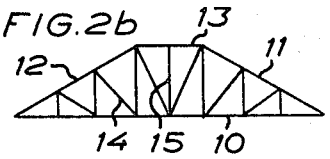
Figure 2C:
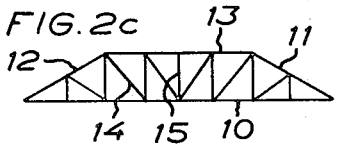
Figure 2D:
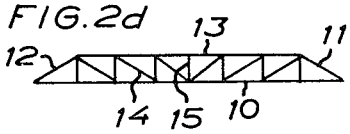

This invention relates to a roof truss assembly for hipped roofs comprising a number of roof trusses of constant ceiling joist length and of a height decreasing stepwise from a maximum height, the roof trusses of reduced height having a rafter piece extending parallel with the ceiling joist, and vertical struts extending between the ceiling joist and the rafter perpendicularly to the ceiling joist, said vertical struts being provided in the same number on either side of the transverse central plane of the roof trusses and the vertical struts on one side of said plane being spaced equally far from said plane as corresponding vertical struts on the other side of said plane.

The invention also relates to a method of manufacturing such roof truss assemblies.

It has been known for a very long time to manufacture roof trusses mechanically by placing the roof truss pieces on a base with so-called gusset plates underlying the junctions to be fixed of the pieces. Joining of the pieces at the junctions is realized by means of so-called nail plates which are mechanically pressed into the material. The orientation of the gusset plates is a circumstantial procedure, and a change of said plates, e.g. for manufacture of one roof truss or a few roof trusses with varying vertical and diagonal positions, will therefore result in unacceptable increases of cost. This is why it is very expensive to manufacture roof trusses for hipped roofs, the vertical and diagonal junctions of which change both along the x-axis and the y-axis, when passing from one roof truss height to another.

The primary object of this invention is to render the manufacture of roof trusses for hipped roofs substantially less expensive. This is realized by means of a roof truss assembly which is characterized in that the number of vertical struts is the same in all roof trusses regardless of their height and at least twice as large as the number of height reduction steps.

Such a roof truss assembly can be manufactured at a relatively low cost by fixing ceiling joist and rafter pieces and vertical strut pieces in a number at least twice as large as the number of height reduction steps on a base by means of gusset plates which are adapted to fix and support the junctions of pieces to be interconnected and of which the gusset plates connecting each vertical strut piece with the rafter and ceiling joist pieces are situated on a line perpendicular to the longitudinal direction of the ceiling joist piece; interconnecting the pieces at the junctions, preferably by means of nail plates; removing the roof truss thus nailed, and fixing and compressing new pieces until the requisite number of roof trusses of maximum height has been obtained; and then manufacturing roof trusses of decreasing height by repeating the process with identical ceiling joist pieces, with rafter pieces consisting of shorter rafter pieces and a rafter piece parallel with the ceiling joist connecting the ends of said shorter rafter pieces remote from the ceiling joist piece, said parallel rafter piece having the requisite length with regard to the roof truss height, and with vertical strut pieces having a length adapted to the roof truss height, said gusset plates for the fixation of the junctions between the rafter piece and the vertical strut pieces being only shifted the requisite distance, likewise determined by the roof truss height, towards the associated gusset plates for the junctions between the vertical strut pieces and the ceiling joist piece along said lines.

Figure 3:
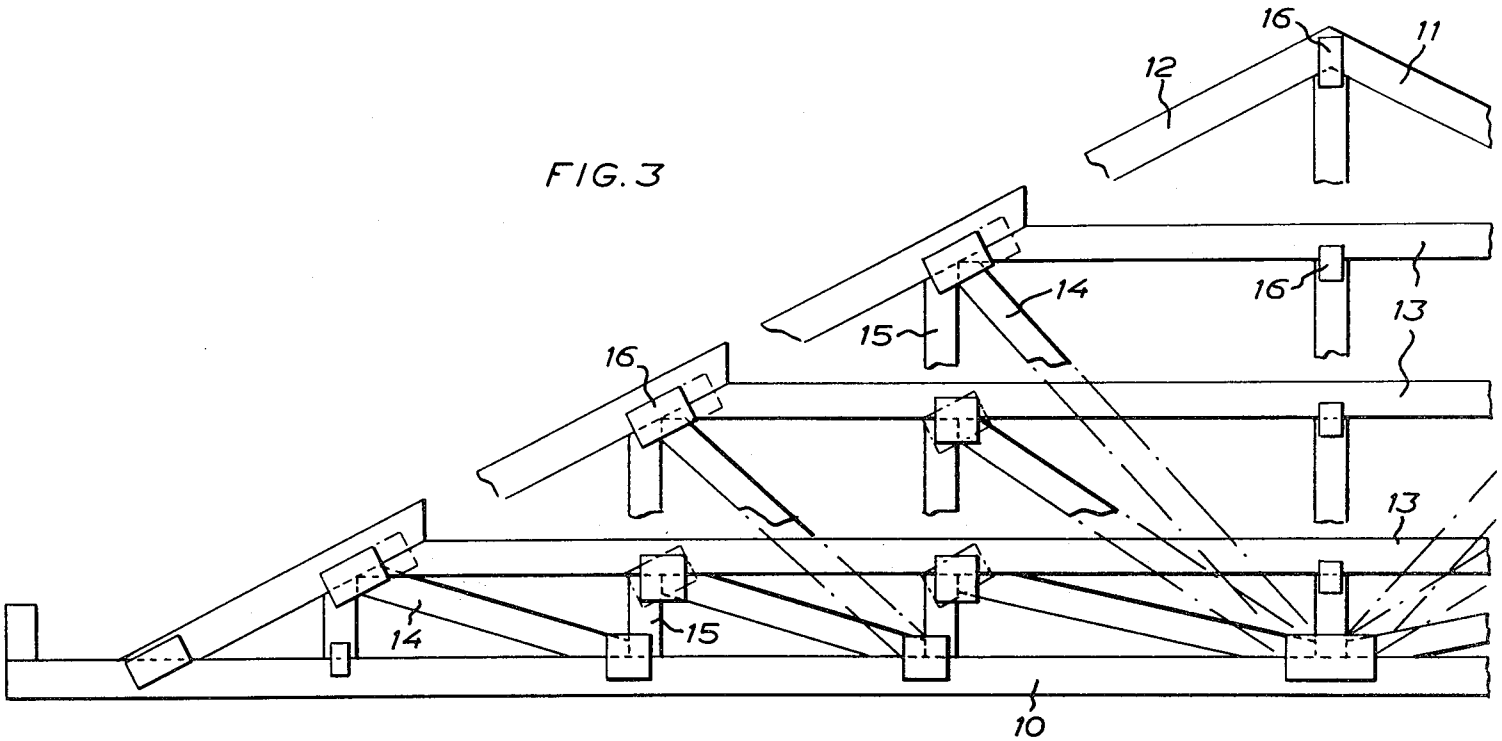

Embodiments of the invention will be described more in detail hereinbelow with reference to the accompanying drawings in which:

FIGS. 1*a*–1 *d* schematically illustrate conventional roof trusses for hipped roofs;

FIGS. 2*a*–2*d* likewise schematically illustrate corresponding roof trusses according to the invention;

FIG. 3 shows a roof truss assembly according to the invention more in detail.

As is well known to those skilled in the art, a hipped roof has four inclined roof surfaces instead of the two roof surfaces of a conventional roof. For said hipped roof use is made of one or more roof trusses of maximum height, as shown in FIG. 1*a*, and, on either side thereof, roof trusses of stepwise decreasing height for providing the two additional oblique roof surfaces. The roof truss according to FIG. 1*a* is manufactured mechanically in a manner likewise well known to those skilled in the art by placing ceiling joist, rafter, vertical strut and diagonal strut pieces on a base with so-called junctions at all locations where the pieces are to be interconnected. Gusset plates are used for fixation of the junctions so that no relative displacement of the pieces occur when so-called nail plates are placed over the junctions and pressed into the pieces with the aid of mechanical press means. The gusset plates are movable along both the x-axis and the y-axis to permit manufacture of roof trusses of various sizes and various appearances. As already mentioned, it is very difficult and time-consuming to move and exactly orient the gusset plates in this manner. Thus, if the roof truss shown in FIG. 1*a* is first manufactured, comprising a ceiling joist 10, a rafter 11, 12, and diagonal struts 14, gusset plates are inserted beneath the junctions of the ceiling joist 10 and the rafter 11, 12, the diagonal struts 14 and the ceiling joist 10 and the rafter 11, 12 as well as of the two studs forming the rafter 11, 12. When passing to a lower roof truss which has a rafter consisting of studs 11, 12, a rafter piece 13 disposed at the ends of the studs remote from the ceiling joist 10 and vertical struts 15 extending between the junctions of the rafter piece 13 and the studs 11, 12, the positions of all gusset plates except those beneath the junctions of the rafter 11, 12 and the ceiling joist 10 will change. It takes in practice about two hours to orient the gusset plates, which entails a cost of about Sw.Kr. 1600 and implies a substantial rise in the price of the roof truss. When passing to the next following roof truss height, shown in FIG. 1*c*, the positions of the gusset plates again change and when passing from said roof truss height to the following, shown in FIG. 1*d*, the positions of the gusset plates again change. The adaptation from the heigth according to FIG. 1*b* to the height 1*c* and from the height according to FIG. 1*c* to the height according to FIG. 1*d* also entails adjusting times of about 2 hours each.

The orientation cost at the manufacture of roof trusses for hipped roofs thus is a considerable part of the total cost of the roof trusses, and as pointed out already, the object of the invention is to as large an extent as possible to simplify the orientation and thus to reduce the cost thereof. For this reason, the roof trusses are formed in an entirely novel manner diagrammatically illustrated in FIG. 2*a* and more in detail in FIG. 3. Ceiling joist and rafters correspond to those in FIGS. 1*a*–1*d*, but the bracing between them has been realized in an entirely novel manner. In the novel embodiment use is thus made throughout of the same number of vertical struts 15 in the roof trusses regardless of their height, and it is apparent that the number of vertical struts is at least twice as large as the number of roof trusses of reduced height. It is readily seen that further vertical struts 15 can be arranged, if necessary. Half the number of the vertical struts 15 are here located on either side of the transverse central plane of the roof truss, the vertical struts 15 on one side being spaced equally far from said plane as corresponding vertical struts on the opposite side of the plane. Further, the vertical struts 15 are disposed so far from said plane as to abut the rafter 11, 12 at a point where at the manufacture of a roof truss of lower height the rafter piece 13 is to be connected with the ends of the rafter studs 11, 12 remote from the ceiling joist 10. At the manufacture of a roof truss assembly according to FIGS. *2a–2d* thus the roof truss of maximum height illustrated in FIG. *2a* is manufactured first. At the manufacture of the roof truss according to FIG. *2b* of reduced height one gusset plate only is shifted from the location where the studs 11, 12 and the vertical strut 15 abut, to the central point on the rafter piece 13 where a central vertical strut 15 abuts. It is readily seen that the orientation cost can be substantially reduced. At the manufacture of the next following roof truss according to FIG. *2c* three gusset plates are shifted and this shift only takes place in the direction at right angles to the longitudinal direction of the ceiling joist 10. When passing to the roof truss embodiment according to FIG. *2d*, apart from the above-mentioned three gusset plates, a further two gusset plates are shifted likewise in the direction at right angles to the ceiling joist 10. It will be realized that the orientation procedure is simplified and made substantially cheaper by the manufacture of a roof truss assembly according to the invention.

In FIGS. *2a–2d* and in FIG. 3 a vertical strut 15 is disposed in the transverse central plane of the roof truss but it can be replaced with vertical struts on either side of said plane. A comparison between the roof trusses in FIGS. *1a–1b* and those in FIGS. *2a–2d*, shows that more wood is required for application of the invention but on the other hand this wood may be of smaller dimensions for the same roof load and/or be of lower quality. The increased cost of wood, however, is very insignificant compared with the saving of cost obtained by the simplified orientation of the gusset plates.

FIG. 3 shows how the ceiling joist 10, the rafter 11, 12, the rafter piece 13, the vertical struts 15 and the diagonal struts 14 are cut to permit manufacturing the roof truss assembly according to the invention. The various pieces are interconnected at all junctions by nail plates 16 which may be of different lengths and fastened in different ways across the junctions, as is shown by full and broken lines, respectively.

What I claim and desire to secure by Letters Patents is:

1. A roof truss assembly for use in supporting hipped roofs comprising:

a plurality of roof trusses each having the same ceiling joist length, said trusses having different heights ranging from a maximum to a minimum in a pre-determined number of height reduction steps, the trusses of less than said maximum height having a rafter piece which extends generally parallel to said ceiling joists, each of said trusses also having a rafter at opposite ends thereof extending generally at an angle from the highest portion of the truss to the ceiling joist;

a plurality of vertical struts disposed in each of said trusses extending from said ceiling joists to said rafters and said rafter pieces, each of said trusses having the same number of vertical struts, one of said vertical struts being generally centrally disposed in each truss, and the remainder of said vertical struts being spaced symmetrically about said central strut and equidistantly from one another; and a plurality of diagonal struts each extending generally from the top of a vertical strut to the ceiling joist.

2. The assembly of claim 1, wherein the number of vertical struts is no less than twice the number of height reduction steps.

* * * * *